United States Patent [19]

Nesser et al.

[11] Patent Number: 4,942,954

[45] Date of Patent: Jul. 24, 1990

[54] VENDING MACHINE

[75] Inventors: Thomas A. Nesser; Deborah L. Nesser, both of Rochester; Herbert Luckower, Harrison; John P. Barczak; Edward P. Joslyn, both of Rochester; Bernard J. Rick, Fairport, all of N.Y.

[73] Assignee: G. T. Norton, Inc., Rochester, N.Y.

[21] Appl. No.: 375,564

[22] Filed: Jul. 5, 1989

Related U.S. Application Data

[60] Division of Ser. No. 277,483, Nov. 29, 1988, which is a continuation of Ser. No. 87,487, Aug. 20, 1987, abandoned.

[51] Int. Cl.[5] ..... G07F 9/06

[52] U.S. Cl. ..... 194/351; 109/47; 109/66; 109/55; 232/15

[58] Field of Search ..... 194/350, 351; 109/45, 109/47, 49, 50, 53-55, 66; 232/15, 16

[56] References Cited

U.S. PATENT DOCUMENTS

| | | | |
|---|---|---|---|
| 2,371,114 | 3/1945 | Stoeser | 232/15 |
| 2,894,612 | 7/1959 | Care | 194/350 X |
| 3,841,550 | 10/1974 | Kaneda et al. | 232/15 |
| 4,037,700 | 7/1977 | Heraty | 194/350 |

FOREIGN PATENT DOCUMENTS

| | | | |
|---|---|---|---|
| 2224950 | 10/1974 | France | 194/350 |

*Primary Examiner*—Joseph J. Rolla
*Assistant Examiner*—Kenneth DeRosa
*Attorney, Agent, or Firm*—Martin LuKacher

[57] ABSTRACT

A vending machine has a carousel containing several rotatable trays stacked one above another. The trays carry and present for vending selected items, such as food and merchandise. The carousel is contained in a housing or canister and is part of an integrated assembly with a coin container. The carousel is filled at a central depot rather than at the site where the machine is installed for use by customers. The customer locations have the cabinet of the machine. Fixed in the cabinet is a drive mechanism for the carousel and locating and guide members which enable integrated assemblies to be removed from the cabinet and fresh assemblies, with the carousel trays loaded at the central depot, to be installed in place of the removed assemblies. The coin box when empty is equipped with a mechanism which is set to enable coins to drop into the container and is automatically reset so as to close the opening when the assembly is removed from the cabinet. The important advantage of not requiring vending machine servicing personnel for being responsible for stocking or handling of moneys is obtained with this vending machine.

4 Claims, 10 Drawing Sheets

FIG. 3
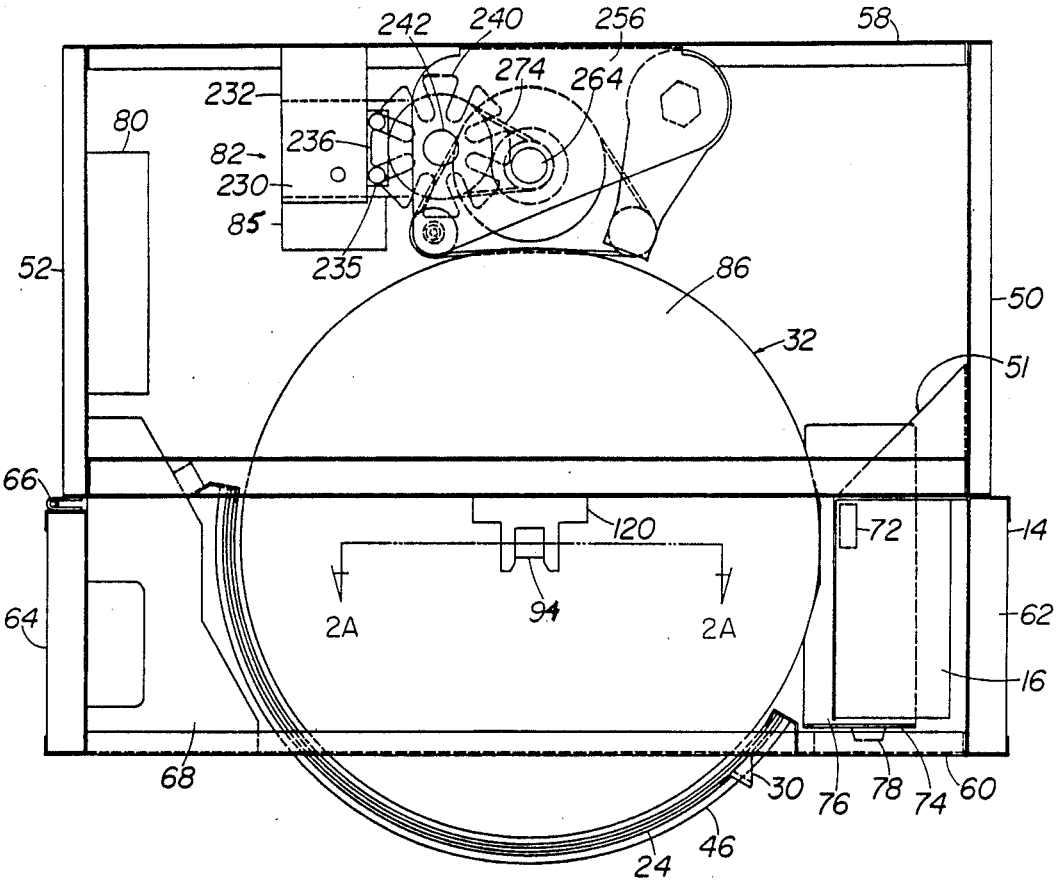
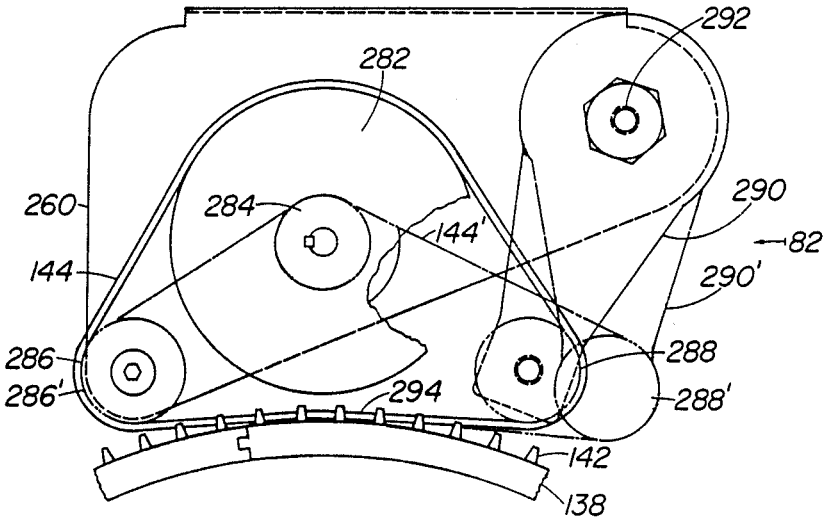
FIG. 5

VENDING MACHINE

This is a division of application Ser. No. 277,483, filed 11/29/88, which is a continuation of application Ser. No. 87,487 filed 8/20/87 (now abandoned).

DESCRIPTION

The present invention relates to vending machines and particularly to vending machines having compartmented rotatable trays in which items to be vended are carried and presented for selection to customers.

The invention is especially suitable for use in vending machines having a stack of rotatable and compartmentable trays assembled in stacked relationship to provide a carousel in which numerous items to be vended may be carried and displayed; the carousel, members for rotating the trays and a coin box being connected in an integrated assembly within a housing or canister enclosing the carousel which is adapted to be received and supported in a cabinet having a mechanism with drive members which engage the members in the assembly by which the trays are driven. The trays may also be referred to as shelves. No merchandise or other items to be vended need be carried by service personnel. Nor do such personnel have to be involved in coin handling. Rather the integrated assembly need only be removed and replaced by a fresh assembly. All merchandise and money handling operations can be performed at the central depot or distribution point. This enables handling of inventory and accounting for moneys to be accurately managed and controlled, thereby increasing the economy, efficiency and profitability of vending machine operations.

There have been some suggestions that machines for vending cigarettes which contain stacks of cigarette packs in cartridges, have cartridge containers which can be replaced, thereby avoiding the need for handling individual cigarette packages to restock the machine. Such machines are mentioned in the following U.S. Patents: Cheslak, U.S. Pat. No. 3,486,658 issued Dec. 30, 1969; Applebaum, U.S. Pat. No. 4,008,827 issued Feb. 22, 1977; and Kiefer, U.S. Pat. No. 4,051,978 issued Oct. 4, 1977, Krakaur, U.S. Pat. No. 4,317,604 issued Mar. 2, 1982. Where a large variety of different types of items are handled, cartridge machines are not suitable. A popular type of vending machine for handling a large number and variety of items is the carousel style of machine. Such machines have been proposed in various styles and forms for upwards of 75 years. Exemplary U.S. Patents are: Hughes, U.S. Pat. No. 1,173,720 issued Feb. 29, 1916; Holland, U.S. Pat. No. 1,446,010 issued Feb. 20, 1923; Dodson, U.S. Pat. No. 2,466,159 issued Apr. 5, 1949; Barker, U.S. Pat. No. 2,854,305 issued Sept. 30, 1958; Brugger, U.S. Pat. No. 3,075,670 issued Jan. 29, 1963; Johnson, U.S. Pat. No. 3,102,762 issued Sept. 3, 1963; Johnson, U.S. Pat. No. 3,122,401 issued Feb. 25, 1964; Johnson, U.S. Pat. No. 3,146,043 issued Aug. 25, 1964; Johnson, U.S. Pat. No. 3,158,417 issued Nov. 24, 1964; Burks, U.S. Pat. No. 4,049,154 issued Sept. 20, 1977; and Wittenborg, U.S. Pat. No. 4,498,603 issued Feb. 12, 1985. In all such carousel type machines the carousel is a permanent fixture assembled in the cabinet of the machine together with the drive mechanism for the carousel trays and the coin box. The service worker travels along a route from machine to machine carrying an inventory of merchandise for restocking the machines. The service worker also handles the money and must account for spoilage and damage. It is also almost impossible to correlate the inventory of merchandise with the money deposited and collected by the service personnel.

Another problem with carousel type machines is their complexity and maintainability. Such machines oftentime, as will be apparent from the above cited patents, are highly complex and contain a large number of parts which must be maintained in alignment in order to prevent jams and to allow the machine to operate satisfactorily.

It is the principal object of the present invention to Provide an improved vending machine of the type having rotatable trays on which products to be vended are disPosed, as in a stack or carousel, which are integrated assemblies both removable and replaceable in a cabinet containing drive mechanisms for rotating the tray or trays; the drive mechanisms being permanently mounted in the cabinet and disposed for engagement with driven mechanisms on the tray or trays when the assembly is received in the cabinet.

It is a further object of the present invention to provide an improved vending machine of the carousel type wherein the carousel and coin box are an integrated, removable and replaceable assembly which can be restocked and from which money can be removed at a central depot, such that service personnel need only transport the integrated carousel assemblies from the depot to the vending machine sites and interchange assembles at those sites.

It is a still further object of the present invention to provide an improved vending machine with an integrated product and money handling assembly which is removable and replaceable in the cabinet of the machine having a coin box which is automatically sealed when the assembly is removed from the cabinet.

It is a still further object of the present invention to provide an improved vending machine having a drive mechanism engageable with driven members on the tray or trays of a removable vending machine carousel unit which is readily implementable with interchangeable parts and can drive different trays of the carousel at different rates so that each tray can carry different size compartments and present such compartments in succession simultaneously at openings which give access to the compartments.

Briefly described in general terms, a vending machine embodying the invention has a cabinet. A drive mechanism is fixedly mounted in the cabinet and presents a drive member in at least one predetermined position in the cabinet. A housing or canister has in integrated assembly therewith at least one carrier (a tray, for example) for items to be vended. The tray is rotatably supported in the housing and has a driven member in a predetermined position corresponding to the position of the drive member. The driven member, when engaged with the drive member rotates the carrier. The housing also has locating members. Supporting guide members are fixedly mounted in the cabinet and present surfaces engageable with the locating members of the housing for removably receiving the housing and the entire integrated assembly in supported relationship in the cabinet. The spacial relationship between the locating and support and guide members aligns the driven member on the carrier in engagement with the drive member of the drive mechanism.

In addition, a coin receiving container (money box) is attached to the housing and is part of the integrated assembly. This container is provided with a plate cooperative with a latching member. The latching member is engageable with a detent member which allows the plate to be maintained in a position opening the box for the reception of coins when the assembly is placed in, the cabinet. The detent mechanism engages the latch and releases the plate to close the coin box when the assembly is removed from the cabinet. Both restocking and money handling is possible only at the depot where replacement assemblies are made available to service personnel so that they can be transported to vending machine sites. The assemblies which are removed from the cabinets are then returned to the depot, the money removed from the box through a locked access door and the assemblies restocked for replacement. The lock box is also reset in position to receive coins.

The trays may be rotated about a shaft, the ends of which, and if desired other legs on the bottom of the housing provide the locating members. The drive mechanism may include, in the case of an assembly having a plurality of trays, a plurality of drive members suitably in the form of belts which are mounted for rotation about a common drive shaft at positions spaced along the axis of rotation of the trays corresponding to the position of driven members which are engaged in driving relationship with the belts when the assembly is installed in the cabinet. A single motor driven mechanism is rotatably coupled to the shaft. Each of the pulleys at the different axially spaced positions may be of different size so that the shelves can be rotated at different rates. Each shelf may have a different number of compartments which are successively presented, since the shelves rotate by different angular amounts, at access openings in the housing.

After the integrated assembly is received in the cabinet, it may be captured therein by a door which is pivotally mounted on one of the walls of the cabinet and which contains a coin mechanism. The door may include sliding windows and a access mechanism operated by the coin mechanism (both the coin mechanism and the access mechanism being of the type conventionally used in vending machines) for releasing one of the windows and enabling it to move just sufficiently to gain access to a compartment on one of the trays.

The foregoing and other objects, features advantages of the invention, as well as a presently preferred embodiment thereof, will become more apparent from a reading of the following description in connection with the accompanying drawings in which:

FIG. 3 is a sectional plan view, the section being taken along the line 3—3 which is shown in FIG. 2;

FIG. 5 is a fragmentary sectional view taken along the line 5—5 in FIG. 4, and also showing a cog wheel in engagement with a drive belt of the part of the drive mechanism which rotates a centrally located one of the trays;

Figure 1:
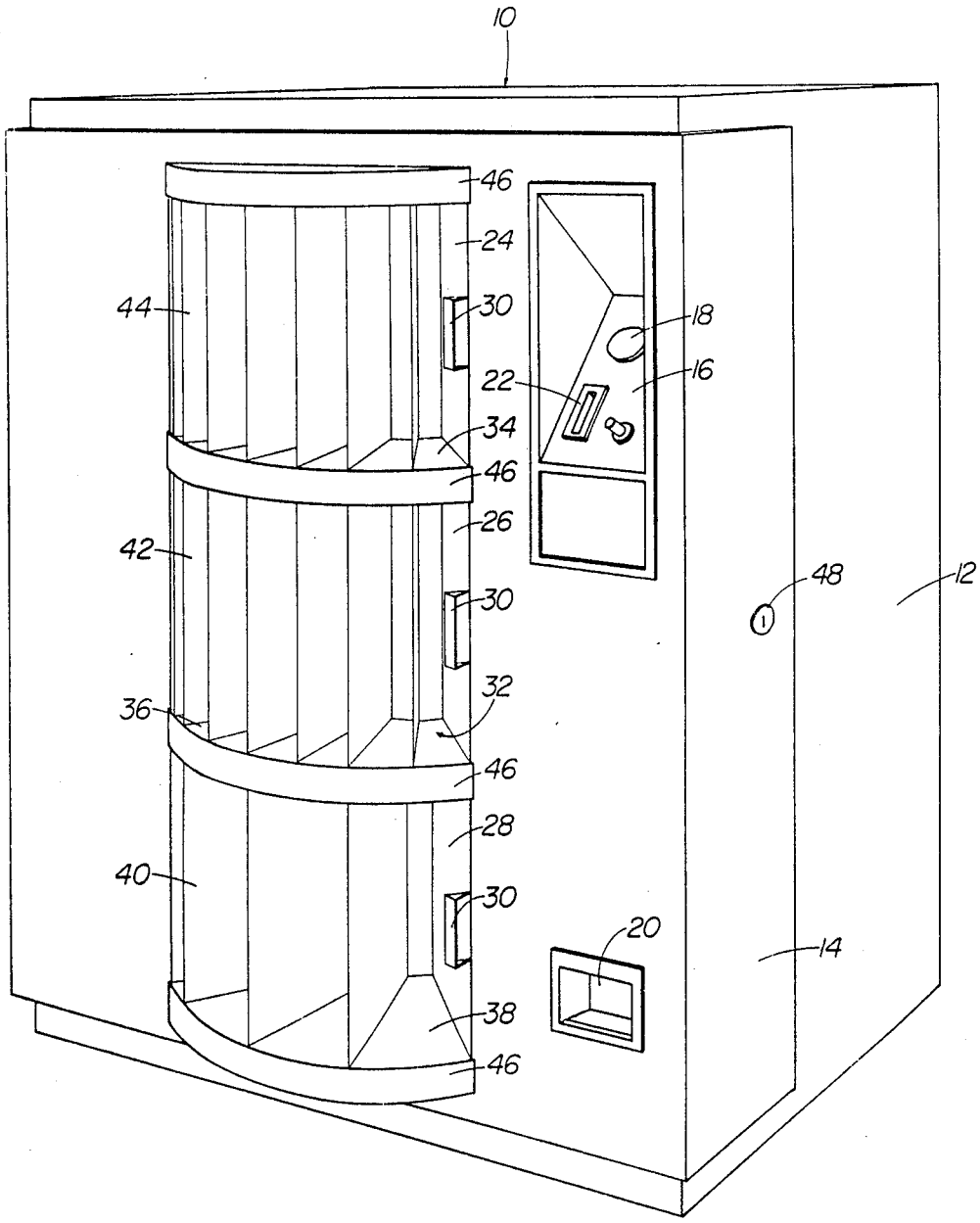
FIG. 1 is a perspective view of a vending machine embodying the invention.

Referring to FIG. 1, there is illustrated the external form of a vending machine 10 embodying invention. The machine has two assemblies. One of these includes the cabinet 12. The front wall of the cabinet is a door 14 which is pivotally mounted on hinges attached to the side wall of the cabinet which appears on the left in FIG. 1. A coin mechanism 16 of conventional design is attached to a side wall 50 of the cabinet with a bracket 51 (FIG. 3). A part of this mechanism is the electrical controls which may be operated by a push button 18 for selecting the item to be vended. The coin mechanism includes a coin return which empties into a receptacle 20 below the coin slot 22 of the mechanism 16.

Also part of the door assembly are sliding arcuate shape windows 24, 26 and 28. The windows are of transparent material and are actuated by handles 30. The windows expose parts of the integrated assembly 32 which carries the items to be vended. The assembly 32 also contains the money received in payment for the items, and also contains the means whereby the selected item may be moved to a location where it can be removed by the customer.

The integrated assembly 32 is portable as a unitary body. It has a carousel of three rotatable carriers in the form of tray assemblies 34, 36 and 38. Divider partitions 40 partition the tray assembly 38 into compartments. Other dividers, 42 on the tray assembly 32 and 44 on the tray assembly 34, also partition these tray assemblies into compartments. In the illustrated embodiment, the dividers 40 are 24° apart, the dividers 42 are 12° apart and the dividers 44 are 8° apart. It will be appreciated that different numbers of tray assemblies and different arrangements of dividers may be used, as desired, depending upon the nature of the items to be vended. For example, there may be like numbers of dividers with like spacing in each tray assembly. The tray assemblies with larger number of dividers may be stacked at the top rather than at the bottom, etc.

The angular displacement of each window is controlled by a mechanism containing stops which is internal of the door 14 such that the opening permitted is only large enough to provide access to a single compartment. The opening may be somewhat less than 8° in the case of the window 24, less than 12° in the case of the window 26 and less than 24° in the case of the window 28.

Bands 46, which are part of the door 14, frame each window and hide the mechanism of the integrated assembly which is located behind the bands. The door has a lock mechanism 48 which is opened by the service personnel. The only duty of the service personnel is to remove the integrated assembly 32 and to replace it with a fresh integrated assembly. This pick-up and delivery function is far and away simpler and less time consuming, and requires a lower skill level from personnel, than is presently the case with carousel type vending machines where the service personnel must stock the machine, collect the money and account for both merchandise and funds. All of the stocking and money collection and accounting functions can, with vending machines in accordance with the invention, be performed at a central depot or a distribution center under controlled conditions thereby reducing losses and making the vending operation more efficient and economical.

Figure 2:
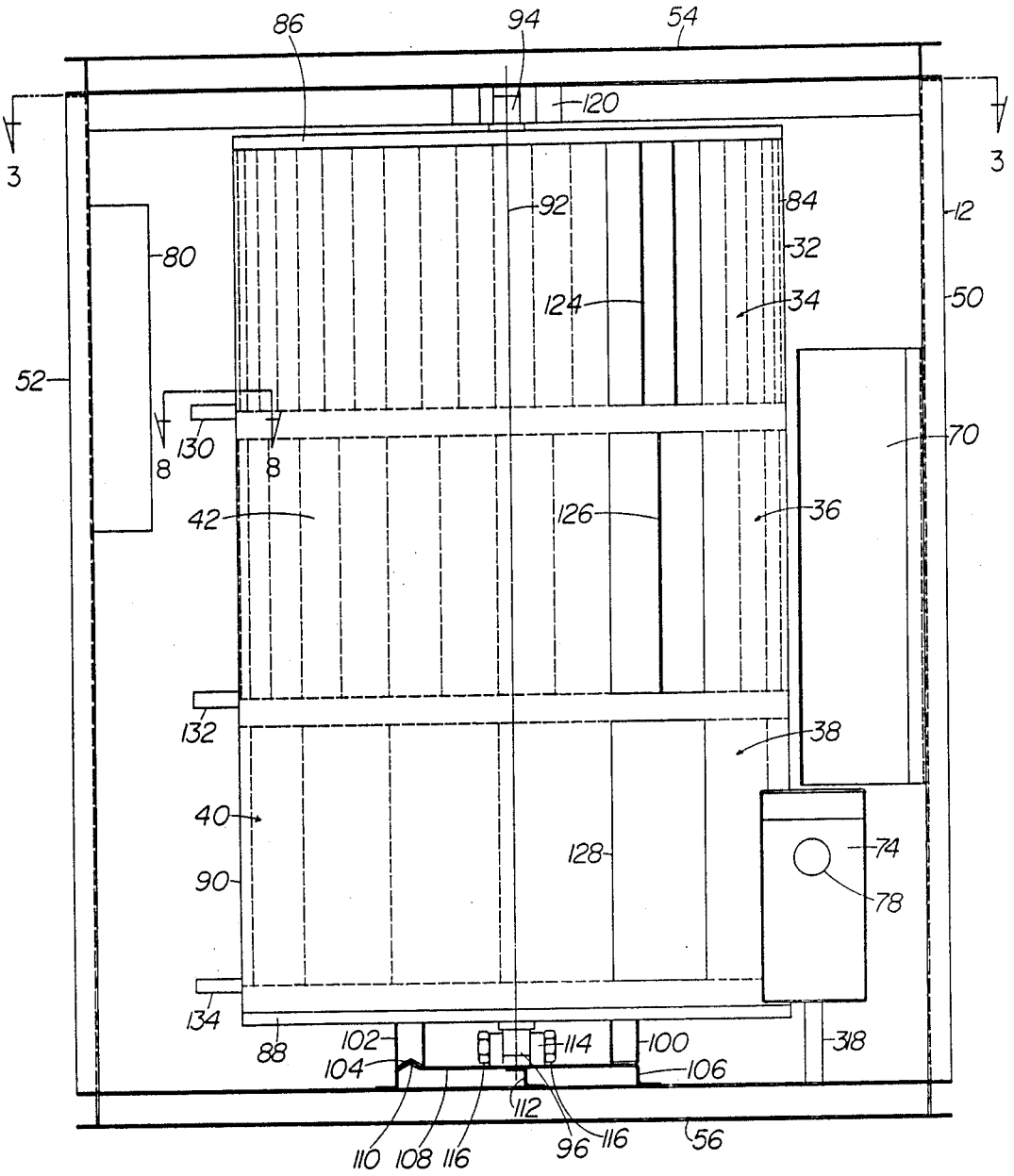
FIG. 2 is a view, in elevation, of the vending machine shown in FIG. 1 with the front door of the cabinet removed and showing the integrated assembly which may be removed and replaced as an entity.

Referring next to FIGS. 2 and 3, the cabinet 12 is shown constructed, as of sheet metal, and having side walls 50 and 52, top and bottom walls 54 and 56 and a rear wall 58. The door 14 has a front wall 60 and sides 62 and 64. Hinge assemblies 66 attach the door 14 to the side wall 52. The bands 46 have grooves in which the windows (24, 26 and 28) are slideably mounted. The corner of the door 14 has the mechanism 68 for releasing the sliding windows 24, 26 and 28 and allowing them to move by distances just sufficient to provide access to the selected compartment.

The coin mechanism 16 may also be mounted on the door 14 together with a chute 70 which directs the coins from the mechanism into an opening 72 in a coin box 74. The coin box 74 is part of the integrated assembly 32. The coin box 74 has a removable compartment 76 with a lock 78 on the front wall thereof. This lock 78, unlike the lock 48 which unlocks the cabinet, is openable only by personnel at the central distribution depot where moneys are collected. The side wall 52 may also have mounted thereon an electrical connection box 80 to which connections are made from a drive mechanism 82 which is mounted on the rear wall 58 of the cabinet. This drive mechanism has an electrical motor 85 (FIG. 4) which together with all of the other electrical mechanical mechanisms of the coin mechanism 16, and the window release mechanism 68 are connected with harnesses to the box 80. The electric power to the vending machine 10 is brought into the box 80 by a power line (not shown).

The cabinet 12, with its door 14, the coin receiving mechanism 16, the door control mechanism 68 and the drive mechanism 82, are Part of the vending machine which is located at customer sites. This part of the machine contains all the electrical components as well as the drive mechanism. The coin mechanism 16 and the sliding door release mechanism 68 are of conventional design used in many vending machines. The drive mechanism 82 is uniquely adapted for use with the removable integrated assembly 32 containing the compartmented carousel and the means whereby the trays thereof can be driven. The mechanism 82 is of such design that it is readily implemented, contains a relatively few number of parts and is adapted to rotate different trays at different rates so as to present successive compartments 40, 42 and 44 (FIG. 1) at the access openings at the same time even those these compartments have different sizes at the front ends thereof (e.g., of 8, 12 and 24 degrees as explained above).

The integrated assembly 32 has a cylindrical housing or canister 84 with top and bottom ends 86 and 88, and a cylindrical shell 90. See also FIG. 2A a tubular shaft extends along the axis of rotation 92 of the trays 34, 36 and 38, which is also the axis of the canister 84. The ends of this shaft are solid stubs 94 and 96 which project from the top and bottom ends 86 and 88 of the canister 84. These shaft ends or stubs 94 and 96 provide locating members for the integrated assembly 32. Further locating members are provided by legs 100 and 102. The leg 102 has a V-shaped key way 104 at the bottom thereof. The bottom wall 56 of the cabinet has support and guiding and locating means provided by a generally rectangular bracket 106 having a flat upper surface 108 except for a V-shaped key 110 which is engaged by and supports and locates the inverted V-shaped key way 104 of the leg 102. Further support for the bracket 106 is by a Z-shaped bar 112.

Mounted on the bracket 106 by screws is a body 114 which presents a slot for receiving the shaft and 96. Bolts 116 having pimples 118 (see FIG. 2A) also align and locate the shaft end 96, which has corresponding depressions. A similar body 120 is attached to and depends from the top wall 54 of the cabinet 12 into the door area as shown in FIG. 3. This body 120 is aligned with the body 114 as well as with the rest of the support and locating means provided by the bracket 106 to the end that the integrated assembly 32 is located with its axis 92 vertical and spaced in the cabinet so that the tray's driven members will be engaged with the drive mechanism 82 when the integrated assembly 32 is located in the cabinet 12. Upon location is the cabinet and the door being closed, the brackets and dimples 118 capture the integrated assembly 32 in alignment with the other mechanisms of the door assembly, and the vending machine is ready for operation.

The shell 90 may be made of transparent material in the sectors 24, 26 and 28 thereof which face the sliding windows. In the locations of each of the trays which is opposite the portion of the sliding windows which are adapted to be opened when an item is selected, there are found in the shell 90, rectangular openings 124, 126 and 128. These openings are respectively slightly less than 8°, 12° and 24° wide so as to provide access to the selected compartments in the trays when the sliding windows are opened.

Each of the tray assemblies has associated therewith a separate detent mechanism 130, 132 and 134. These mechanisms are described in greater detail in connection with FIGS. 8 and 9. They serve to index the trays to provide alignment with the access openings 124, 126 and 128 as will be apparent from the description of the drive mechanism which follows in connection with FIGS. 4 and 5.

Figure 6:
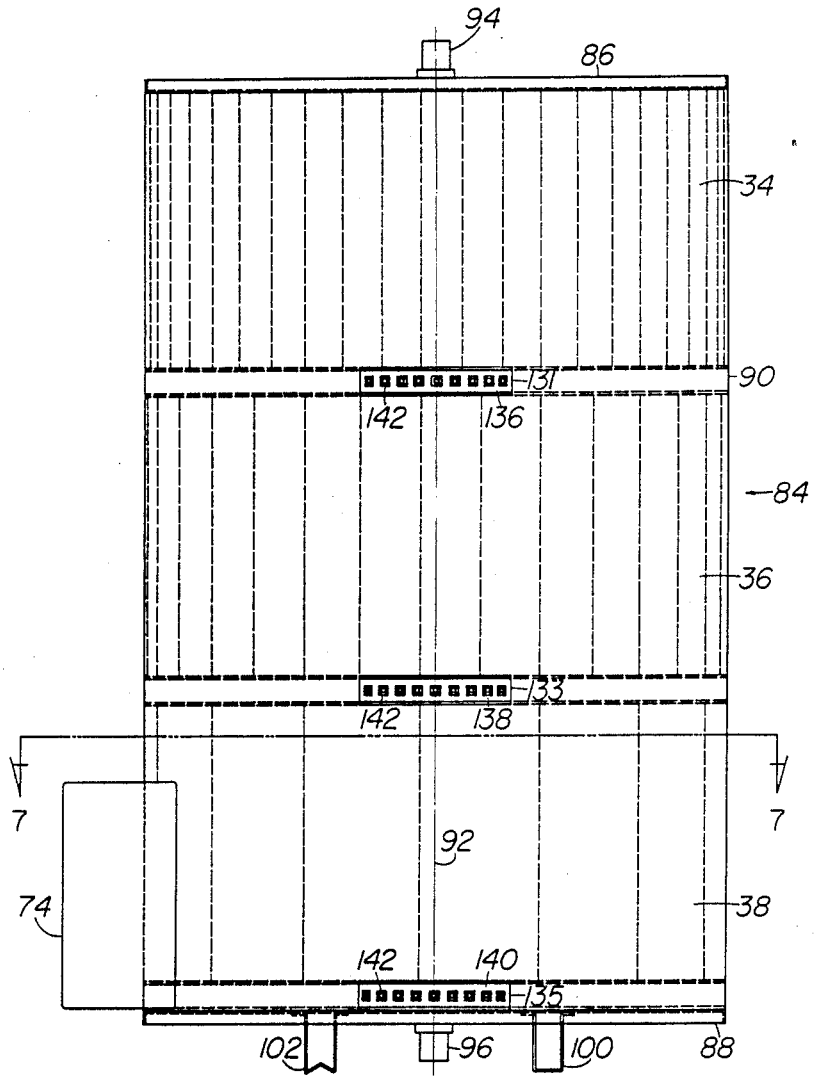
FIG. 6 is a view in elevation of the integrated assembly taken from the rear thereof, the assembly being shown removed from the cabinet.

Referring to FIG. 6, it will be seen that there are rectangular openings in the shell 90 in the area of the bands 46 (FIG. 1) between the tray assemblies 34, 36 and 38. These openings 131, 133 and 135 Provide access to the drive mechanism of driven members 136, 138 and 140, which are rings having cogs 142, as shown on the exposed portion of the ring 140 in FIG. 6, these cogs or teeth 142 engage in slots in drive member belts (e.g., belt 144—FIG. 5), when the integrated assembly 32 is received in the cabinet 12. The construction and operation of the of drive mechanism and the drive belt 144 will be discussed more fully below.

Figure 2A:
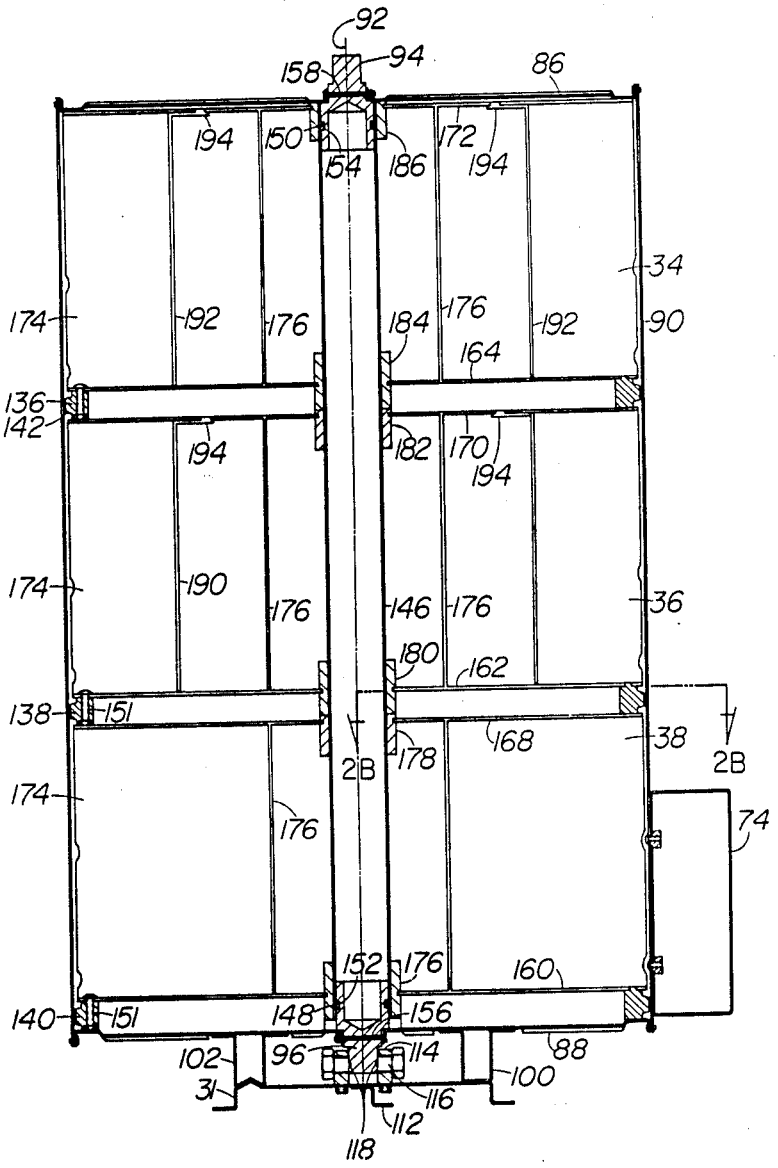
FIG. 2A is a sectional view, the section being taken along a vertical plane through the axis of rotation of the trays, that is along the line 2A—2A in FIG. 3.
Figure 2B:
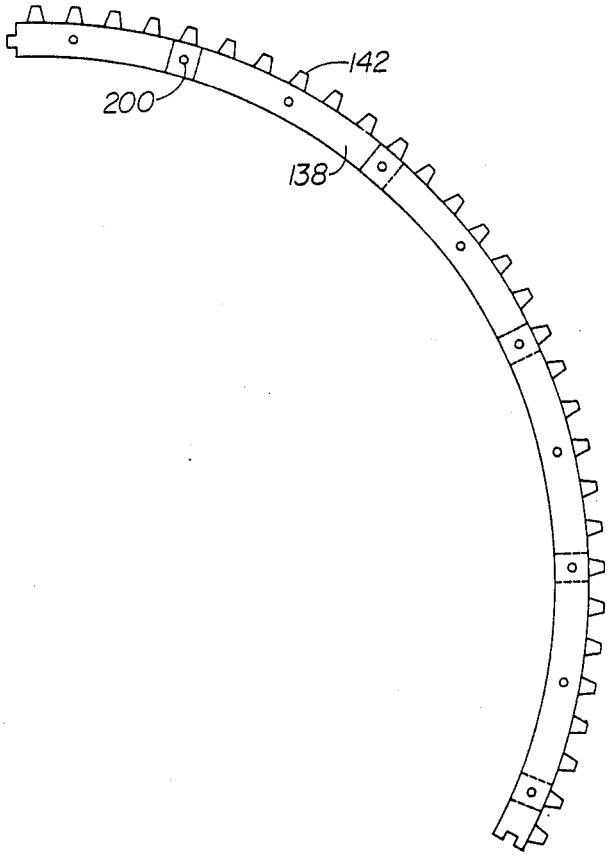
FIG. 2B is a sectional view taken along the line 2B—2B in FIG. 2A and showing a segment of the cog wheel providing the driven member on one of the trays of the carousel assembly contained within the canister or housing of the removable integrated assembly of the vending machine.

Referring to FIGS. 2A and 2B, it will be seen that the canister 84 is an assembly of the shell 90, the top and bottom ends 86 and 88 and a central tubular shaft 146 with the shaft ends 94 and 96 assembled by a pressed fit and held by crimped rings 148 and 150 which enter into circular slots 152 and 154 in the shaft ends 96 and 94. These rings and slots oppose any thrust in the direction of the axis 92. Cotter pins 156 and 158 oppose any torque forces.

The tray assemblies have bottom plates or shelves: 160 for the assembly 38; 162 for the assembly 36; and 164 for the assembly 34. The cog rings 136, 138 and 140 are attached by bolts and nuts to the peripheries of these shelves and depend below the shelves. The cog ring 140 rests upon the bottom end 88 which provides a bearing surface or track for the ring. Resting upon the shelves 160, 162 and 164 are cover discs 168, 170 and 172 of the same diameter as the shelves 160. Vertical partitions 174, 24° apart (see FIG. 7) stand on the shelves 160, 162 and 164 and are supported by vertical Plates 176 (see also FIG. 7). The shelves, covered discs, partitions and plates can be made of sheet metal and assembled together by rivets or other attachment means (not shown).

The cog rings 136 and 138 are attached by nuts and bolts 151, as shown for the rings 138 and 140, at the bottom of the shelves 162 and 164. The lower face of these rings 136 and 138 bear and ride upon the upper surface of the cover discs 168 and 170. The inner ends of the tray assemblies 34, 36 and 38 which are provided by the inner PeriPheries of the shelves 160, 162 and 164 and the cover Plates 168, 170 and 172 are journaled for rotation around the shaft 146 in bushings 176, 178, 180, 182, 184 and 186. It will be seen therefore that each of the tray assemblies 34, 36 and 38 is independently rotatable when their cog rings 136, 138 and 140 are rotated. The housing 84 therefore contains a carousel of stacked tray assemblies, each of which may be rotated at a different rate, so as to present compartments of different size successively at the access openings 124, 126 and 128. Some of these compartments are provided by dividers consisting of additional partitions 190 which divide the comPartments defined by the major partitions 174 in half. The tray assembly 36 therefore has thirty comPartments spaced 12° apart. Compartments spaced 8° apart are provided by double dividers 192 between the shelf 164 and its cover disc 172. These dividers 192 divide the 24° compartments into 8° compartments. The dividers 190 and 192 may be connected by means of snap-in pins 194 which can enter openings in the cover discs 170 and 172.

Figure 7:
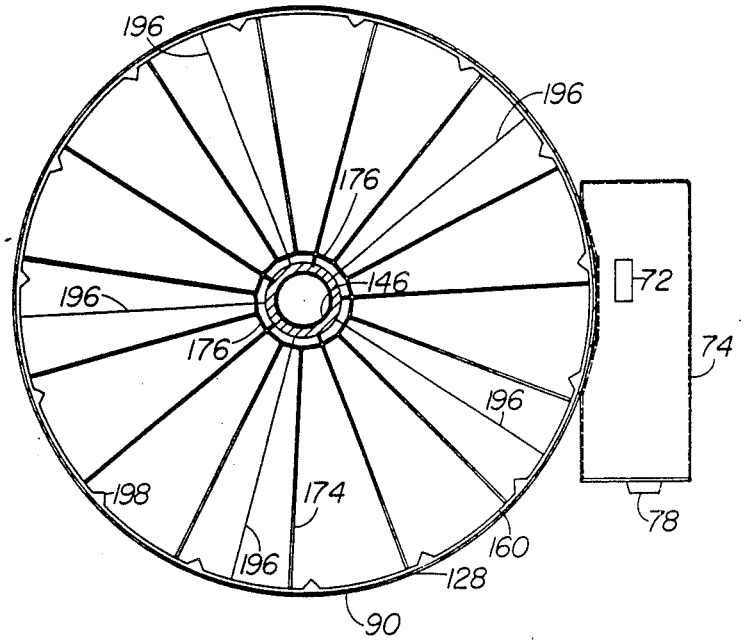
FIG. 7 is a sectional plan view taken along the line 7—7 in FIG. 6 and showing dividers defining the compartments of the one of the trays having the widest compartments as compared to the width of the compartments on the other trays of the carousel.

Each of the shelves 160 may be made in five parts and assembled in overlapping relationship. The lines 196 in FIG. 7 are the demarcations of each of these parts. The edges of the shelves contain indexing notches 198.

Figure 8:
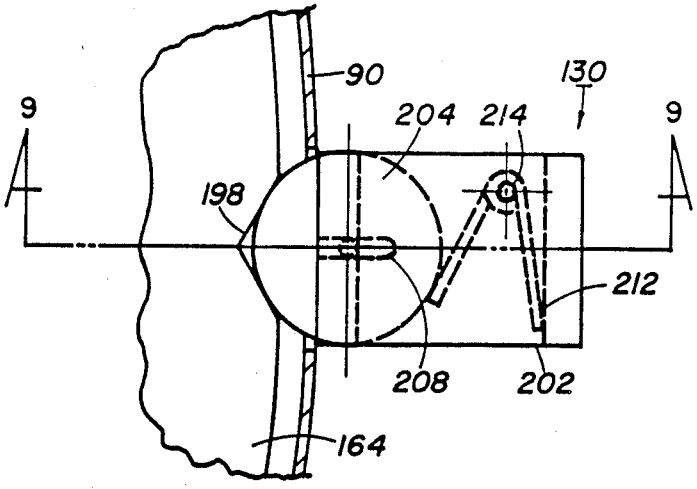
FIG. 8 is a fragmentary sectional view taken along the line 8—8 in FIG. 2 and showing one of the detent mechanisms for aligning one of the trays.
Figure 9:
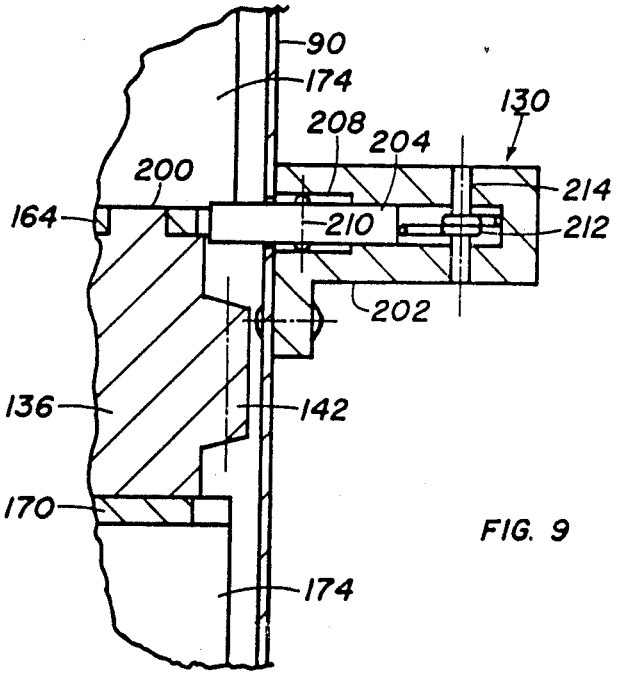
FIG. 9 is a fragmentary sectional view taken along the line 9—9 in FIG. 8.

Referring to FIGS. 8 and 9, a typical one of the mechanisms 130 for indexing the tray assemblies is shown. FIG. 9 also shows how the cog rings are located by stubs 200 to the shelves (e.g., shelf 164) with which they rotate. These stubs 200 are also shown in one of the three segments which make a cog ring in FIG. 2B. These sectors are 120° and have dove-tail connections at the ends thereof.

The indexing mechanisms are provided by brackets 202 which are attached to the shell 90. See especially FIG. 9. The brackets have slots which locate discs 204. One of these slots 208 captures a pin on the center axis 210 of the disc and restrains the disc for movement in a radial direction into and out of the notches 198. The discs are biased by a hairpin spring 212 held in the bracket 202 on a pin 214. The notches 198 and the indexing mechanisms 130 are aligned so that the compartments on the shelves will be located within the access openings 124, 126 and 128 of the shell. A pair of compartments will not bridge the access opening so as to enable a customer to extract merchandise from more than one of the compartments.

Figure 4:
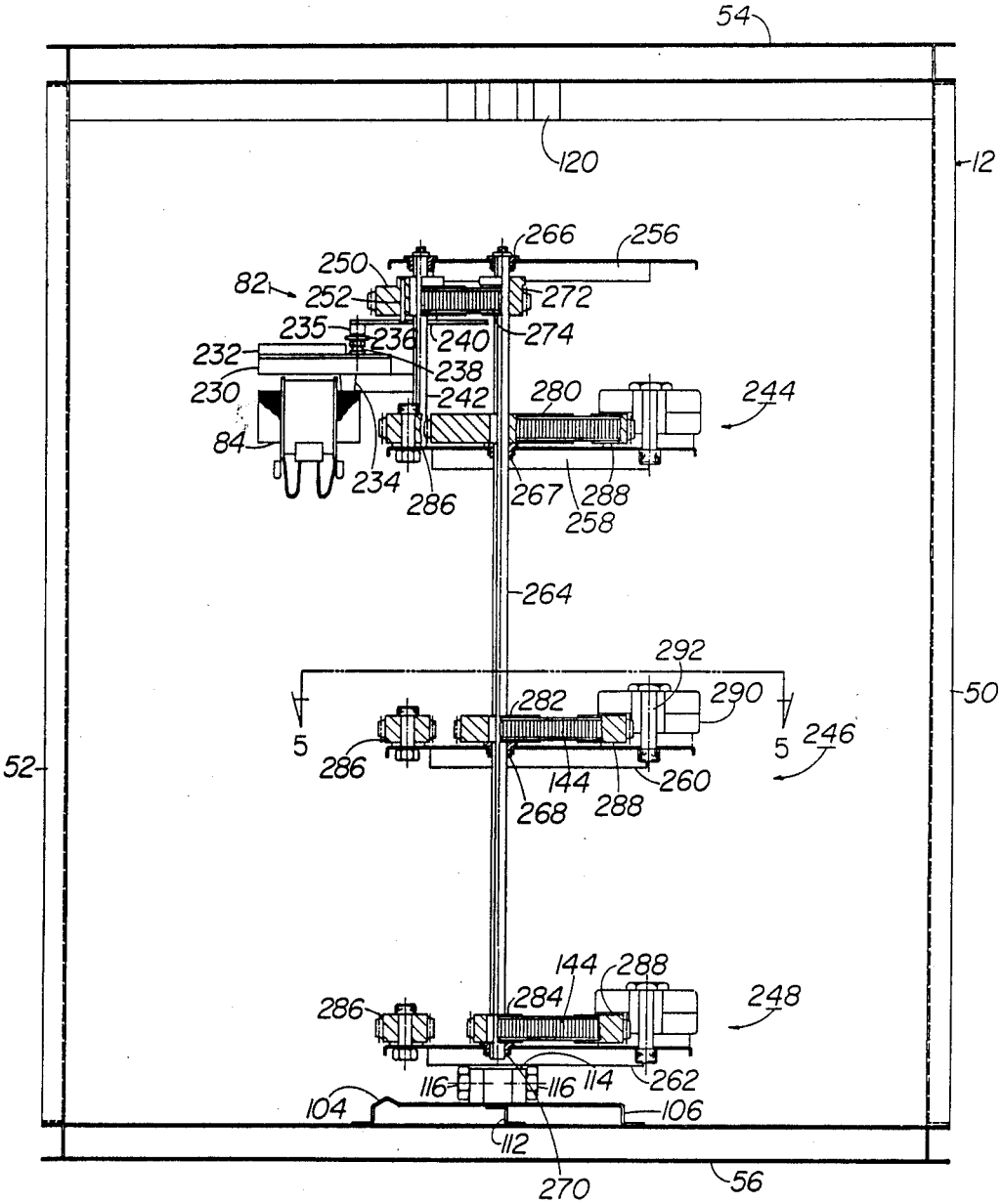
FIG. 4 is an elevational view of the cabinet with the integrated assembly removed and showing the drive mechanism with drive members (belts) which are engageable with the driven members on the trays for rotating the trays.

Referring to FIGS. 3, 4 and 5, the drive mechanism is shown. The motor 85 is an assembly with a gear reducer box 230. The reducer box 230 is connected to the rear wall 58 of the cabinet 12 by a bracket 232. A sleeve 234 which carries the output shaft of the motor into the reducer 230 holds the motor 85 depending from the gear reducer box 230 so that the attachment of the gear box 230 to the rear wall 58 supPorts the motor and gear box assembly.

The motor may be a stepper motor which executes one revolution each time the push button 18 (FIG. 1) is depressed. Alternatively, and as shown in the drawings, an intermittent motion is obtained by a Geneva drive including a set of Pins 235 on a bar 236 which is rotated by the output shaft 238 from the gear reducer 230. These Pins enter into slots in a Geneva wheel 240. 45° of rotation of a shaft 242 occurs with each 360° rotation of the bar 236. This 45° of rotation of the shaft 242 is converted by the drive mechanism through individual drive, transmissions 244, 246 and 248 into rotation (stepwire) of the tray assemblies 34, 36 and 38, so that each 45° rotation is translated into a 24°, 12°, and 8° rotation of the tray assemblies 38, 36 and 34, respectively.

The shaft 242 carries a cog ring (which also can be called a cog gear 250). The Geneva wheel 240 is pinned by a pin 252 to the cog gear 250. This gear is keyed to the shaft 242 and held in place by suitable mechanisms such as C-washer (not shown). The shaft is mounted in a bracket 256 which is attached to the rear wall 58 of the cabinet 12. This bracket 256 and brackets 258, 260 and 262, which support the transmissions, 244, 246 and 248, also support a common shaft 264 which is rotatably mounted, in each of the brackets 256, 258, 260 and 262, in bushings 266, 267, 268 and 270. The axis of the shaft 264 is parallel to the axis of rotation 92 of the trays in the canister 84.

The shaft 264 is coupled to the shaft 242 by a cog gear 272 and a belt 274 which is entrained around the cog gear 250 and 272. This belt is a flexible belt having alternate slots and bars; the cogs being receivable in the slots between the bars. Such belts are commercially available as from Winifred M. Berg, Inc., East Rockaway, N.Y. 11518; their model 12GCF.

Each of the transmissions 244, 246, and 248 is of a similar design. The only difference between the transmissions is the size of a drive cog wheel or pulley thereof which is mounted for rotation with the shaft 264. This drive pulley 280 in the case of the transmission 244 is of largest diameter. The drive pulleys 282 and 284 of the transmissions 246 and 248 are of smaller diameters. The diameters are selected so as to provide the requisite differential rate of rotation of the trays for the purpose of presenting successive compartments with each rotation of the motor as discussed above.

The transmissions also include a pair of idler pulleys which may be in the form of cog wheels 286 and 288. FIG. 5 shows the drive pulley 282 in full for the transmission 246. The drive pulley 284 for the transmission 248 is shown in lines made up of long dashes followed by a Pair of short dashes. The idler pulley 286' of the transmission 248 is immediately below and in alignment with the idler pulley 286. The idler pulley 288 of the mechanism 246 is mounted on a arm 290 which is pivotal about a Pin 292. A spring (not shown) around the pin biases the arm 290 in the counterclockwise direction as viewed in FIG. 5.

The lower mechanism 248 has a similar arm 290' which carries the idler 288' at the end thereof. The belt 144, which is similar to the belt 274 and has adjacent bars and slots for receiving the cogs 142, is entrained around the drive pulley and the idlers in each mechanism. The belt 144, of the transmission 248 is of the same length (or diameter, since it is an endless loop). The difference in length is taken up by the pivotally mounted, spring biased idler 288'. The idlers 286 and 288 present a reach 294 of the belt 144 between the idlers 286 and 288 for engagement with the cog rings 136, 138 and 140 when the integrated assembly 132 is in place in the cabinet 12. The reach 294 defines a sector congruent with the sector in the cog rings which are exposed through the openings 131, 133 and 135 (see FIG. 6). Accordingly, a single motor provides a step wire, intermittent drive for the entire carousel enabling each tray to be driven at a different rate and facilitating the use of compartments of different size in each tray assembly.

Figure 10:
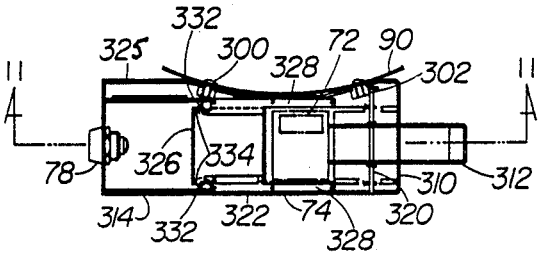
FIG. 10 is a sectional plane view taken along the line 10—10 in FIG. 12 and showing the coin box.
Figure 11:
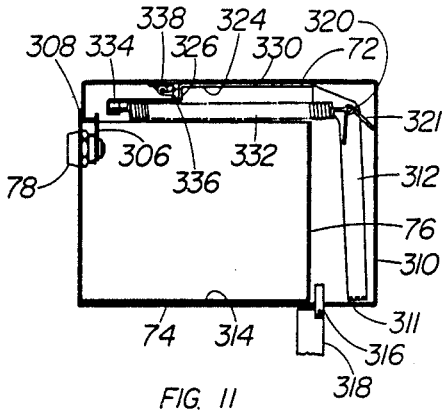
FIG. 11 is a sectional elevational view of the coin box taken along the line 11—11 in FIG. 10.
Figure 12:
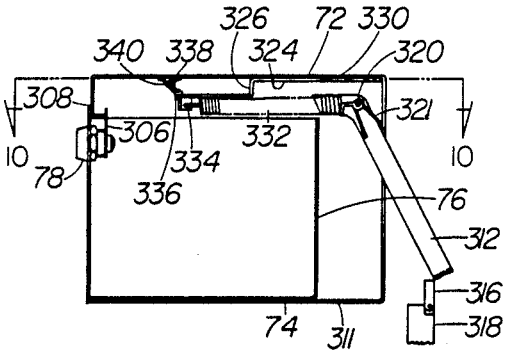
FIG. 12 is a view similar to FIG. 11, but showing the coin box in position as it is being removed with the integrated assembly, the closure plate having been released to seal the coin receiving opening at the top of the box.

Referring to FIGS. 10, 11 and 12 there is shown the coin box 74 which is attached to the shell 90 of the housing of the carousel 84 by means of nuts and bolts 300 and 302. The coins are collected in the removable compartment 76 of rectangular cup shaPe which is removable from the coin box 74 only when the proper key is turned in the lock 78 to rotate a blocking bar 306 out of engagement with a depending flange 308. The coin box 74 has an opening (suitably a slot) in its rear end 310 through which a bellcrank lever 312 may extend when the lever is pivoted rearwardly (in a counterclockwise direction as shown in FIGS. 10 and 12). The box 74 also has a floor 311 through which a continuation of the slot extends; the slot terminating before the rear end of the coin collecting container 76.

This slot allows the passage of a finger 316 which is mounted on a bracket 318 which projects upwardly from the bottom wall 56 of the cabinet (see also FIG. 2). This finger 316 is in position to intercept the lower or longer arm of the bellcrank 312. The bellcrank is pivotally mounted on a pin 320 which extends across the side walls 322 and 325 of the coin box 74. A hairpin spring 321, which bears against the rear wall 310 of the box 74 and into a hole into the lower arm of the bellcrank 312, biases the bellcrank for rotation in the clockwise direction about the pivot pin 320, as shown in FIGS. 11 and 12.

A closure plate 324 having a step 326 is slideably mounted in guide bars 328 so as to move from the position shown in FIGS. 10 and 12, where the opening 72 to the coin box is sealed by the closure plate 324, to the position shown in FIG. 11, where the closure plate is moved to the left so that an opening 330 therein is in alignment with the opening 72 in the coin box. This is the position of the openings 330 and 72 shown in FIG. 11.

The closure plate 324 is biased by springs 332 which are connected between the Pin 320 and ears 334 at the forward end of the closure plate 324.

A detent latch 336, which is spring biased by a hairpin spring 338 in the counterclockwise direction, is pivotally mounted on pin 340 which extends across the sides 322 and 325 of the coin box 74. The latch 336, the bellcrank 312 and the finger 316 provide a triple detent mechanism for assuring that the coin box opening 72 will be sealed with the integrated assembly 32 including the coin box when it is removed from the cabinet 12.

Initially and back at the depot the coin container 76 is removed. The detent latch 336 is then released manually. The latch is turned in the counterclockwise direction and forces the closure to the rear slightly until the latch clears the closure plate. Then the closure plate is allowed to move forward until again stopped by the latch 336. In the position where the closure plate is stopped by the latch, the upper arm of the bellcrank 312 engages the rear edge of the closure plate. This latches the closure plate in open position where the opening 72 in the coin box is aligned with the opening 330 in the closure plate.

When the integrated assembly is inserted into the machine, the lower lever arm of the bellcrank 312 strikes the finger 316. The finger is disposed in a notch which is opened towards the rear and can pivot in a clockwise direction enabling the bellcrank 312 to continue in the position shown in FIG. 11 where the closure plate is latched in its open position. However, when the integrated assembly is removed from the cabinet, the lower lever arm of the bellcrank 312 cannot pass the finger 316 without being pivoted in a counterclockwise direction as shown in FIG. 12 because the step of the bracket 318 acts as a stop. Then the closure plate is moved slightly to the left as shown in FIGS. 11 and 12 until it clears the uPper edge of the bellcrank 312. Under the bias of the springs 332, the closure plate moves to the right. The latching detent 336 then can move downwardly into position against the forward edge of the closure Plate and latches the closure plate in closed position where the opening 72 and 330 are out of alignment so that the closure Plate lockingly seals the coin box. Access to the coin box is not permitted until authorized personnel with the key for opening the lock 78 are present. This can occur only at the central distribution depot under controlled conditions.

From the foregoing description, it will be apparent that there has been provided imProved vending apparatus, and particularly an improved vending machine having a carousel, coin box and associated members for driving the carousel trays which provides an integrated assembly bodily removable from a cabinet wherein the rest of the vending machine components are permanently installed. Opportunities for pilferage of coins and merchandise are reduced with vending machines embodying the invention. Also such machines are not limited any more than any machine of the carousel type in the sizes of products to be vended. Variations and modifications in the herein described vending machine, within the scope of the invention, will undoubtedly suggest themselves to those skilled in the art. Accordingly, the foregoing description should be taken as illustrative and not in a limiting sense.

We claim:

1. Coin receiving apparatus which comprises a coin box having a coin container having an opening for receiving coins, a closure plate moveably mounted in said container and being moveable in opposite directions to open and close said opening, means internal of said container for biasing said closure plate to move in the closing direction, first detent means for latching said plate in open position, and second detent means with respect to which said container is moveable and having means enabling it to be engaged and moved by siad first detent means when said container moves towards said second detent means so as to leave said first detent means in latched relationship with said open closure plate and to be engaged by said first detent means when siad container moves away from said second detent means for actuating said first detent means to release said closure plate for movement in the closing direction.

2. The apparatus according to claim 1 further comprising third detent means within said container and engageable with said closure plate when it is moved in the closing direction to closed position for latching said closure plate in closed position.

3. The apparatus according to claim 2 further comprising a lockable door on said container providing access for the removal of coins and the manual release of siad third detent means and the manual actuation of said closure plate to open position in latched relationship with said first detent means.

4. The apparatus according to claim 2 wherein siad first detent means comprises a bellcrank lever having a firs arm engageable with a rear end of said closure plate, a spring attached to said arm for biasing it towards said rear edge, said second detent means comprising a pivotal finger pivotable in a direction towards said rear edge, a stop for limiting the movement of said finger towards said rear edge beyond a predetermined position, said bellcrank having a second arm disposed for engagement with said finger pivoting said finger when moving with said container in the direction towards said second detent means and being pivoted by said finger when moveable in a direction away from said second detent means until said finger reaches said stop when said bellcrank is pivoted to release said closure plate.

* * * * *